US007125471B2

(12) United States Patent
Hill, Jr. et al.

(10) Patent No.: US 7,125,471 B2
(45) Date of Patent: Oct. 24, 2006

(54) PAPERMAKING PROCESS USING ENZYME-TREATED SLUDGE, AND PRODUCTS

(75) Inventors: Walter B. Hill, Jr., Germantown, TN (US); Brian G. Hart, Memphis, TN (US); Lowell F. Lott, Memphis, TN (US); Robert J. Turnbull, Cordova, TN (US); James W. Fitzhenry, Memphis, TN (US); Daniel E. Glover, Brighton, TN (US); Philip M. Hoekstra, Cordova, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 263 days.

(21) Appl. No.: 09/996,516

(22) Filed: Nov. 29, 2001

(65) Prior Publication Data

US 2003/0102095 A1 Jun. 5, 2003

(51) Int. Cl.
*D21H 11/14* (2006.01)
*D21H 21/16* (2006.01)
*C12S 3/08* (2006.01)

(52) U.S. Cl. ..... 162/189; 162/5; 162/158; 162/183; 162/185; 435/278

(58) Field of Classification Search ..... 162/72, 162/189–191, 158, 161, 183, 185, 199, 4, 162/5; 210/632; 435/267, 277, 278
See application file for complete search history.

(56) References Cited

U.S. PATENT DOCUMENTS

| | | | | |
|---|---|---|---|---|
| 3,047,452 | A * | 7/1962 | De Vos | 162/5 |
| 4,356,060 | A | 10/1982 | Neckermann et al. | 162/181.6 |
| 4,410,573 | A | 10/1983 | Narymskaya et al. | 428/2 |
| 4,923,565 | A * | 5/1990 | Fuentes et al. | 162/72 |
| 4,936,994 | A * | 6/1990 | Wiatr | 210/632 |
| 5,176,796 | A * | 1/1993 | Irie et al. | 162/174 |
| 5,240,565 | A | 8/1993 | Williams | 202/99 |
| 5,330,619 | A * | 7/1994 | Johnson et al. | 162/5 |
| 5,356,800 | A | 10/1994 | Jaquess | 435/188 |
| 5,501,770 | A * | 3/1996 | Sarkar et al. | 162/100 |
| 5,507,952 | A | 4/1996 | Jaquess et al. | 210/632 |
| 5,527,432 | A | 6/1996 | Leuthold et al. | 162/319 |
| 5,762,756 | A | 6/1998 | Scott et al. | 162/4 |
| 5,780,283 | A | 7/1998 | Lee | 435/188 |
| 5,962,555 | A | 10/1999 | Glover | 523/411 |
| 6,017,751 | A * | 1/2000 | von der Osten et al. | 435/263 |
| 6,066,233 | A * | 5/2000 | Olsen et al. | 162/5 |
| 6,093,282 | A * | 7/2000 | Ryu et al. | 162/4 |
| 6,120,648 | A | 9/2000 | Scott et al. | 162/261 |
| 6,241,849 | B1 * | 6/2001 | Franks | 162/5 |
| 6,413,363 | B1 * | 7/2002 | Hsu et al. | 162/4 |
| 6,610,172 | B1 * | 8/2003 | Lund et al. | 162/72 |

FOREIGN PATENT DOCUMENTS

| | | |
|---|---|---|
| SU | 1 049 597 A | 10/1983 |
| WO | WO 99/43780 | 9/1999 |

OTHER PUBLICATIONS

U.S. Appl. No. 09/883,140.

* cited by examiner

*Primary Examiner*—Eric Hug
(74) *Attorney, Agent, or Firm*—Kilyk & Bowersox, P.L.L.C.

(57) ABSTRACT

Enzyme-treated papermaking sludges are provided, as are methods of making the enzyme-treated sludge. Papermaking processes that incorporate the enzyme-treated papermaking sludges into papermaking pulp are also provided as are paper and paperboard products made from the resultant pulp.

15 Claims, 4 Drawing Sheets

PAPERMAKING PROCESS USING ENZYME-TREATED SLUDGE, AND PRODUCTS

BACKGROUND OF THE INVENTION

The present invention relates to papermaking processes and products made from these processes. More particularly, the present invention relates to papermaking processes wherein sludge generated from a papermaking process is recycled in the same process.

The manufacture of paper involves blending, in water, a pulp material (generally wood fiber) with fillers, such as clay, and other additives to create a stock slurry mixture referred to herein as a pulp. The pulp is then processed through a papermaking machine to form a sheet. The water is then extracted from the sheet and the sheet is then pressed and dried, thereby forming a paper product. The drained water contains an amount of fiber and filler material. This material is collected for later processing, however, the recovery is usually not complete. Discarded material and material not captured for reuse are generally transported to a waste treatment facility where still-remaining solids, e.g., the fibers and filler materials, are removed. The cleaned water is discharged back into the environment or communicated back to the papermaking process for reuse. After dewatering, the solids are contained in a concentrated, typically 40%–60% solids, papermaking sludge. The main components of this sludge are fibers and clay filler material. This sludge is usually disposed of by burying in landfills, landspreading, or incinerating. Some papermaking processes recycle papermaking sludge, however, this has been found to adversely affect sizing and cause size reversion.

In papermaking, "sizing" refers to the ability of paper or paperboard to resist water adsorption, water penetration, or both. "Sizing" also refers to sizing materials, sizing compositions, and sizing additives, such as an alkenyl succinic anhydride (ASA) sizing emulsion. When sizing is lost during a papermaking process, or during storage, printing, processing, or converting, the loss is referred to as a "size reversion."

Size reversion may occur without the loss of sizing material. Extractables, hydrolyzed sizing, or both, can mask sizing in the paper or paperboard product without a loss of sizing material. In some processes, extractables in the product promote the loss of sizing. In processes where papermaking sludge is added back into the papermaking process, significant amounts of sizing materials can be lost and increased size reversion occurs.

The addition of different additives and certain processing conditions can also adversely affect sizing and increase sizing reversion. The addition of recycled sludge in a papermaking process often introduces such additives or conditions.

A need exists for a papermaking process, particularly a process wherein papermaking sludge is recycled in the process, that minimizes the loss of sizing material in the resultant paper or paperboard product, and minimizes size reversion.

SUMMARY OF THE INVENTION

The present invention provides a method of making paper or paperboard that includes combining at least one enzyme composition and at least one papermaking sludge to form an enzyme-treated sludge, and subsequently combining the enzyme-treated sludge with a papermaking pulp. The enzyme composition preferably has at least one of lipase activity and cellulase activity, and may preferably have cellulase and hemicellulase activity. The enzyme-treated sludge can be added at any of several points of addition in a papermaking system, including at or prior to the headbox of the system. The resulting pulp or stock, that includes the enzyme-treated sludge, is subsequently formed into a sheet of pulp from which a paper or paperboard product is produced. Preferably, the resultant paper or paperboard product exhibits improved sizing, sizing retention, and resistance to size reversion.

The present invention also provides a papermaking system for carrying out the above-described methods, paper and paperboard products made according to the methods and/or with the system, and enzyme-treated sludge additives for papermaking processes.

It is to be understood that both the foregoing general description and the following detailed description are exemplary and explanatory only and are only intended to provide a further explanation of the present invention, as claimed. The accompanying drawings, which are incorporated in and constitute a part of this application, illustrate several embodiments of the present invention and together with description, serve to explain the principles of the present invention.

DETAILED DESCRIPTION OF THE PRESENT INVENTION

Figure 1:
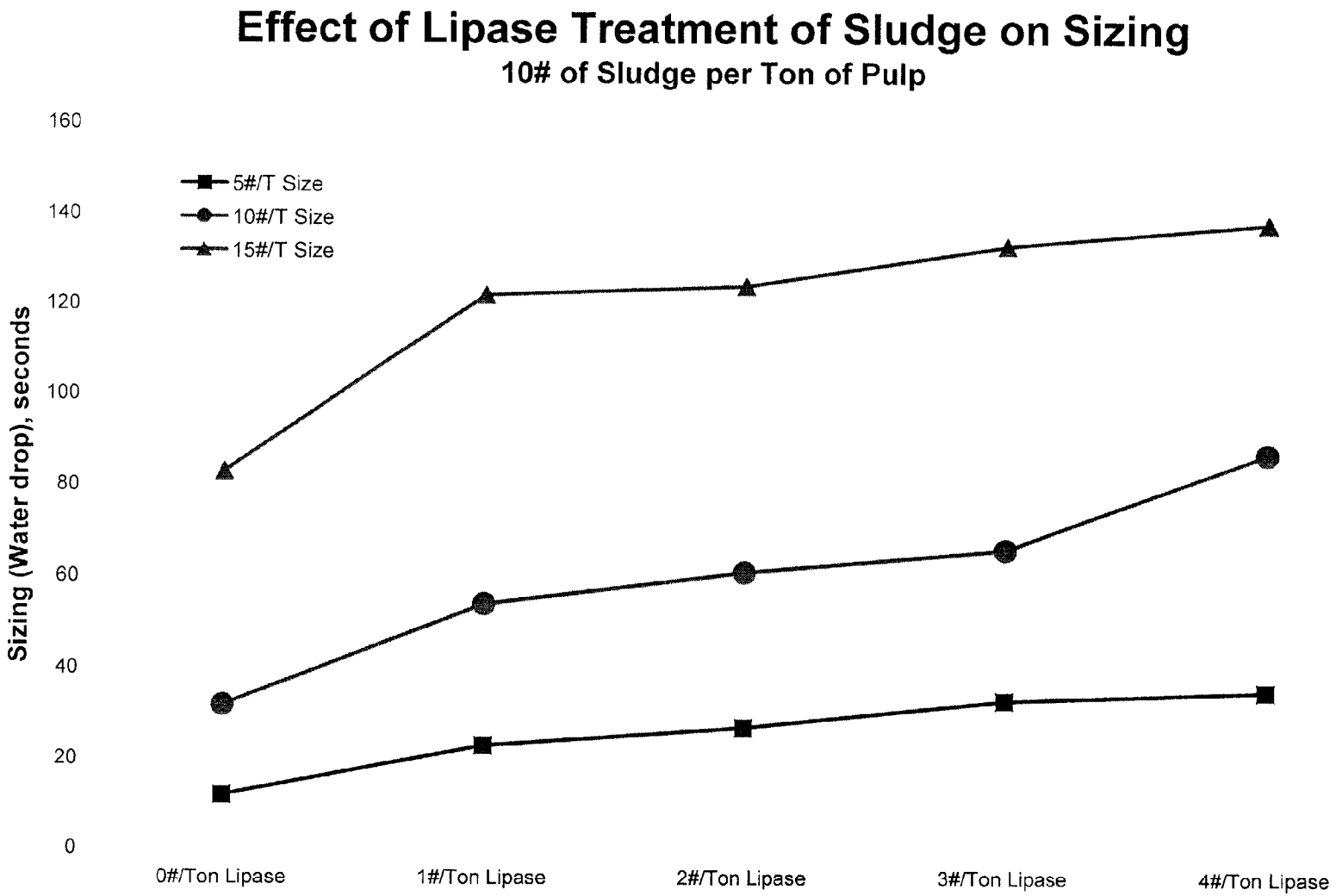
FIG. 1 is a graph showing the effect that an enzyme-treated sludge has on the sizing of a paper product made by a process according to an embodiment of the present invention.

The present invention provides methods of making paper or paperboard. According to the present invention, at least one enzyme composition is combined with at least one papermaking sludge to form an enzyme-treated papermaking sludge. Herein, the treated sludge is referred to as an "enzyme-treated sludge." The enzyme-treated sludge is subsequently added to a papermaking pulp in a papermaking system. Herein, the phrase "papermaking pulp" refers to papermaking pulps, papermaking stocks, and papermaking furnishes. The enzyme-treated sludge is preferably added back into or recycled to a papermaking system from which the sludge was generated. Whether the papermaking sludge to be treated is generated from the same process to which the enzyme-treated sludge is added, or from a different process, the resulting pulp containing the enzyme-treated sludge is then formed into a paper or paperboard product according to the present invention. Paper and paperboard products according to the present invention preferably exhibit excellent sizing, sizing retention, and resistance to size reversion. The method of the present invention can be practiced on conventional papermaking machines with modifications that can be made in view of the present description.

The present invention also relates to enzyme-treated sludge that is useful as an additive for a papermaking process and that preferably improves sizing, sizing retention, and resistance to size reversion in a paper or paperboard product made according to a process of the present invention which utilizes the enzyme-treated sludge. The present invention further relates to methods of making such an enzyme-treated sludge.

The methods of the present invention can employ, and the products of the present invention can contain, many different types of papermaking pulp or combinations thereof. For example, the pulp can comprise virgin and/or recycled pulp, such as virgin sulfite pulp, broke pulp, hardwood kraft pulp, softwood kraft pulp, mixtures of such pulps, and the like. The addition of enzyme-treated sludge according to the present invention is particularly well-suited for use with linerboard pulps wherein sizing is generally more critical than with many other paper and paperboard products.

According to the present invention, sizing material is preferably added to a papermaking pulp to improve sizing in a paper or paperboard product made from the pulp. To improve sizing, by retaining sizing material in the finished paper or paperboard product, and/or to improve resistance to size reversion, enzyme-treated sludge is added to the pulp according to the present invention.

Sizing materials that can be added to a papermaking pulp include, but are not limited to, conventional sizing additives. ASA sizing emulsions are particularly preferred and can include those emulsions described, for example, in U.S. Pat. No. 5,962,555, which is incorporated herein in its entirety by reference. Another exemplary sizing material that can be used is alkyl ketene dimer (AKD sizing) and the like. The sizing additive can contain other ingredients besides a sizing material, such as, for example, surfactants.

To size paper using an ASA sizing emulsion, the emulsion is preferably added before the paper sheet forming step in a papermaking process. The sizing emulsion may be added as far back in a papermaking process as the thick stock, but is preferably added just before the headbox of a papermaking machine. As is known in the art, a sizing emulsion should be added in such a way to insure proper distribution on the fibers. To insure proper distribution, the sizing emulsion can preferably be diluted to from about 1% to about 3% solids, based on the dried solids weight of the emulsion, then added before the screens or fan pump just prior to the pulp slurry entering the head box. Other amounts can be used. This dilution, followed by dispersion by the screens and/or fan pump, aids in distributing the sizing emulsion to achieve uniform distribution on the fibers.

Other sizing additives, exemplary sizing material chemistry, amounts of sizing additives, sizing additive ingredients, sizing reactions with cellulose, and methods of adding sizing additives, that are suitable to form a sized papermaking pulp useful in accordance with the present invention, are described in U.S. Pat. No. 5,962,555 which is incorporated herein in its entirety by reference.

According to the present invention, an enzyme-treated sludge is added to a sized papermaking pulp to improve at least one of sizing, retention of sizing material, and resistance to size reversion. Preferably, the enzyme-treated sludge consists essentially of a papermaking it sludge and an enzyme composition. According to an embodiment of the present invention, the enzyme-treated sludge can contain from about 50% to about 100% by weight papermaking sludge and from about 1% by weight to about 50% by weight enzyme composition, based on the dried solids weight of the papermaking sludge and the enzyme composition. The papermaking sludge that is treated to form the enzyme-treated sludge of the present invention can be any of various sludges generated in a papermaking process. The sludge can include, but is not limited to, compositions containing one or more types of fibers of one or more wood types. The sludge can contain fibers of one or more lengths, including fines. Other materials that can be included in papermaking sludges as defined herein include, but are not limited to, ASA sizing materials, hydrolyzed sizing materials, polymers useful for flocculating and/or coagulating the pulp or sludge, polymers useful as retention aids, stickies, glues, inks, fillers, other impurities from recycled paper, defoamers, and surfactants.

Papermaking sludges, methods of recovering papermaking sludges, and methods of recycling papermaking sludges are described, for example, in U.S. Pat. Nos. 6,120,648; 5,762,756; 5,527,432; 5,240,565; and 4,356,060; each of which is incorporated herein in its entirety by reference. According to an embodiment of the present invention, sludge is taken out of the white water silo of a papermaking system in a clarifier assisted by the use of single or dual polymers. The water is reused throughout the papermaking mill while the sludge is added to the pulper at rates of from about 5 pounds to about 200 pounds per ton of papermaking pulp based on the dried solids weight of the sludge and pulp, more preferably, from about 20 pounds per ton to about 100 pounds per ton. The enzyme composition used for treating the sludge may contain any conventional papermaking pulp-treating active enzyme, but preferably contains one that has cellulytic activity, such as a cellulase enzyme. Other components can be present as long as these other components do not negatively affect the activity of the enzyme composition. Preferably, the enzyme composition exhibits both cellulytic and hemicellulytic activity. The enzyme composition may preferably contain lipase.

Suitable enzymes and enzyme-containing compositions include those described in U.S. Pat. No. 5,356,800 to Jaquess, U.S. patent application Ser. No. 09/031,830 filed Feb. 27, 1998, and International Publication No. WO 99/43780, all incorporated herein in their entireties by reference. Other exemplary paper making pulp-treating enzymes that can be used according to the present invention to treat the sludge are BUZYME™ 2523 and BUZYME™ 2524 enzyme compositions, both available from Buckman Laboratories International, Inc., Memphis, Tenn.

The enzyme composition preferably contains from about 1% to about 30% by weight enzyme based on the dried solids weight of the composition, more preferably, from about 5% to about 20% by weight enzyme. These amounts can vary and can be below or above the ranges provided depending upon the specific enzymes used. Generally, enzymes are formulated based on their activity. The preferred enzyme composition can further contain polyethylene glycol, hexylene glycol, polyvinylpyrrolidone, tetrahydrofuryl alcohol, glycerine, water, and other conventional enzyme composition additives as described, for example, in U.S. Pat. No. 5,356,800.

A preferred enzyme composition contains about 65 % glycerine (CAS#56-81-5 FDA OK—D), about 20% Savinase 16.0L (protease enzyme from NOVO Nordisk), about 14% water (CAS 7732-18-5), and about 1% PVP-K15

(100% polyvinylpyrrolidone of molecular weight of about 9,700), all based on the total weight % of the enzyme composition.

Another preferred enzyme composition useful according to the present invention contains about 30% water (CAS 7732-18-5), about 30% propylene glycol (100% 1,2-Propylene Glycol CAS), about 10% Cellulase 50000 (cellulase for paper/pulp uses), about 16% additional water and inert ingredients, and about 14% of a DMA-EPI-EDA terpolymer (a low-medium molecular weight cationic polyamine comprising epichlorohydrin and dimethylamine units in the form of a water-soluble polymer cross-linked with ethylenediamine), all based on the total weight % of the enzyme composition.

The enzyme composition can contain at least one esterase or lipase, or both, and preferably contains a high concentration of esterase and/or lipase. The lipase can be derived or isolated from pancreatic sources (e.g., pancreatic lipase) or from various fungi and/or bacteria, and/or other microorganisms. Examples include, but are not limited to, triacylglycerol acylhydrolase, and triacyl glycerol lipase. Also, any lipase or esterase capable of hydrolyzing triglycerides to glycerol and fatty acids can be used. Commercially available products containing esterase or lipase can be used. For instance, Buzyme® 2515 and Buzyme® 2517 can be used and are available from Buckman Laboratories International, Inc., Memphis, Tenn. Products containing suitable enzymes, such as Resinase A2X, Novocor ADL, Pancreatic Lipase 250, Lipase G-1000, Greasex 50L, and Greasex 100L, can be used in the methods of the present invention. Such products are available from such commercial sources as Genencor and Novo Nordisk. The esterase or lipase described in U.S. Pat. Nos. 5,507,952 and 5,356,800 can be used in the present invention and these patents are incorporated in their entirety along with any other patents or publications mentioned in this application, by reference herein. The enzyme or lipase can generally be used in any form, such as liquid form or solid form. Preferably, the amount of esterase or lipase used in the methods of the present invention is an amount sufficient to improve sizing, improve retention of sizing materials, and/or improve resistance to size reversion. Preferred amounts of esterase and/or lipase are from about 0.005 lbs. to about 4.0 lbs. per ton of sludge based on the dried solids weight of the sludge, more preferably from about 0.01 pound to about 2.0 pounds per ton, and most preferably from about 0.05 pound to about 0.5 pound per ton of sludge based on the dried solids weight of the sludge. The esterase and lipase compositions are preferably stabilized compositions using the formulations described in U.S. Pat. Nos. 5,356,800 and 5,780,283, which are incorporated herein in their entireties by reference.

In another preferred embodiment of the present invention, the enzyme composition contains at least one polyamide oligomer and at least one enzyme. The polyamide is present in an amount effective to stabilize the enzyme. Exemplary enzyme compositions containing polyamide oligomers and enzymes are described in International Published Application No. WO 99/43780, which is incorporated herein in its entirety by reference.

According to the present invention, the enzyme composition can include a combination of two or more different enzymes. The enzyme composition can include, for example, a combination of a lipase and a cellulase, and optionally can include a stabilizing agent. The stabilizing agent may be a polyamide oligomer.

The enzyme may preferably act to: degrade the papermaking sludge; to reduce waste water solids; to reduce Biological Oxygen Demand (BOD); and to reduce Chemical Oxygen Demand (COD). Preferably, the enzyme acts to reduce stickies, surfactants, contaminants, fines, and anionic trash in the sludge and in whitewater and recycled papers used for making sized paper pulp and paperboard products. The amount of enzyme composition to be added to a papermaking sludge in accordance with the present invention is an amount effective to improve sizing, improve retention of sizing material, and/or improve resistance to size reversion. For example, the enzyme may be added to the sludge in any amount, such as up to 100% by weight enzyme or less than 1% to 10% or more by weight enzyme, with preferred ranges being in an amount of from about 0.0001% to about 1.000% by weight enzyme based on the dried solids weight of the sludge, more preferably from about 0.001% to about 0.100% by weight, and more preferably from about 0.005% to about 0.05% by weight.

The enzyme-treated sludge can generally be added at any location of the papermaking process but preferably is added prior to the headbox in a papermaking system. Preferably, the enzyme-treated sludge is added prior to the whitewater silo, more preferably, prior to the machine chest, and even more preferably, prior to the blend chest. Preferably, the enzyme-treated sludge is added prior to the first refiner in a papermaking process, which is generally located before the blend chest.

After combining the papermaking pulp with the enzyme-treated sludge, the resulting treated pulp or stock can then be processed by a conventional papermaking machine using conventional papermaking techniques.

Cationic starch may be added to the pulp or treated pulp of the present invention to form a starch-treated pulp. Starch may be added at one or more points along the flow of paper making pulp through the papermaking apparatus or system of the present invention. For instance, cationic starch can be added to a pulp or stock at about the same time that the enzyme-treated sludge is added to the pulp or stock. The cationic starch can alternatively or additionally be added to the treated pulp after the pulp is first treated with both the enzyme and cationic polymer. Preferred cationic starches include, but are not limited to, potato starches, corn starches, and other wet-end starches, or combinations thereof.

Conventional amounts of starch can be added to the pulp or stock. An exemplary amount of starch that can be used according to the present invention is from about 5 to about 25 pounds per ton based on the dried solids weight of the pulp or stock.

In addition to or in place of the starch, a microparticle additive may be added to the pulp at any time during the process. The microparticle additive can modify the charge of the pulp, or modify the charge of a component of the pulp. The microparticle additive can be, for example, a charging or modifying agent, a filler, a coagulating agent, and/or a retention aid. The microparticle additive can be a natural or synthetic hectorite, bentonite, zeolite, alumina sol, or any of conventional particulate additives as are known to those skilled in the art.

A biocide may be added to the pulp or stock before or after the addition of the enzyme-treated sludge. For example, a biocide may be added to the treated pulp or stock in a blend chest after the pulp has been treated with the enzyme-treated sludge. Biocides useful in the paper making pulps according to the present invention include biocides well known to those skilled in the art, for example, BUSAN™ 1130, available from Buckman Laboratories International, Inc., Memphis, Tenn.

In the methods of the present invention, at least one polymer can also be added to pre-treat the sludge prior to introduction of the sludge to a papermaking pulp. At least one polymer can be added together with the enzyme composition at about the same time. Alternatively or additionally, one or more polymers can be added before or after the introduction of the enzyme composition. For instance, the polymer(s) can be added one hour or less before or after introduction of the enzyme composition to the sludge. Preferably, if a polymer is added to the sludge, the polymer is a water-soluble polymer and is more preferably a cationic water-soluble polymer. Examples of such polymers include, but are not limited to, epichlorohydrindimethylamine polymers (EPI-DMA) and cross-linked solutions thereof, polydiallyl dimethyl ammonium chloride (DADMAC), DADMAC/acrylamide copolymers, ionene polymers, and the like. The polymer, if used in the methods of the present invention, can be used in any amount and preferably in dosage ranges of from about 0.1 pound to about 15 pounds per ton of sludge based on the dried solids weight of the sludge, more preferably from about 0.25 pound to about 10 pounds per ton of sludge based on the dried solids weight of the sludge, and more preferably from about 1 pound to about 5 pounds per ton of sludge based on the dried solids weight of the sludge.

The enzyme compositions can also optionally contain other conventional paper treatment chemicals or ingredients such as, but not limited to, surfactants, solvents, suspension aids, clays or other fillers, chelants, preservatives, buffers, water, stabilizers, polymers such as cationic, anionic, and non-ionic polymers, dyes, pigments, defoamers, pH adjusting agents such as alum, and other conventional papermaking or paper processing additives. These additional ingredients can be present in any combination and can be used in conventional amounts.

Generally, the enzyme composition is introduced or brought into contact with the sludge in any fashion. The enzyme compositions can be introduced to the sludge during dewatering to form sludge from a papermaking system or after formation and/or collection of the sludge. The contact time of the enzyme composition with the sludge should preferably be maximized. Preferably, the contact time should be sufficient to improve sizing of a resultant paper or paperboard product. Preferably, the contact time is from about 1 min. to about 8 hours, more preferably from about 15 min. to about 4 hours, and most preferably from about 30 min. to about 2 hours.

The enzyme composition can be introduced or brought into contact with the sludge at a singular injection point or at various injection points, or by pouring the enzyme composition into the sludge, or by using repulpable bags of dry or liquid enzymes. The introduction of the enzyme composition can be immediate, slow-release, timed-release, intermittent, and/or continuous. In addition, more than one type of enzyme composition can be used, mixtures can be used, or any other variations as long as at least one cellulase or lipase enzyme is introduced in some fashion in order to improve sizing.

In the methods of the present invention, the improvements in sizing can be incorporated into any papermaking operation. Typically, the remaining aspects of the papermaking operation can be those known to those skilled in the art and can be used in order to form paper and paperboard products. Thus, conventional additive materials used with papermaking pulps during preparation of pulp can be used as well in the present invention. Continuous or non-continuous papermaking machines can then convert aqueous suspensions of fibers and other ingredients into dry sheets of paper or paperboard using such conventionally known operations which involve Fourdrinier machines or cylinder machines or other papermaking devices. Subsequent treatments of the sheets of paper to achieve the desired characteristics such as machine calendering and/or coating of the papersheets and the like can also be used in the present invention.

Enzyme activities, formulations, and modes of action are described in more detail in U.S. Provisional Patent Application No. 60/211,942, filed Jun. 16, 2000, and entitled "Methods to Control Organic Contaminants in Fibers," which is incorporated herein in its entirety by reference. While not wishing to be bound by any theory, it is believed that the effect on sizing achieved from treating the sludge with enzyme before adding the treated sludge in a papermaking process, results from one or more of the following enzyme-promoted events: (1) modification of fiber structures and fiber walls, (2) modification of stickies and other impurities in the sludge, (3) modification of hydrolyzed size and size-fiber bonding and adsorption, (4) degradation and refining of fines, and (5) modification of surfactants.

Having generally described the present invention, a further understanding can be obtained by reference to the following specific examples, which are provided herein for purposes of illustration only and are not intended to limit the present invention.

EXAMPLES

The effect that activated papermaking sludge has on a paper sheet product was tested. A papermaking mill that recycles papermaking sludge by adding it back into a papermaking process was used in the investigation. Samples of papermaking stock from the mill, papermaking sludge from the mill, and whitewater from the mill were collected for the purpose of forming handsheets that could be created in a fashion similar to the manner in which machine board is created in the mill. Handsheets were formed using the papermaking stock with and without the papermaking sludge being added to the stock. The handsheets were created in accordance with TAPPI standards.

Example 1

Four sets of handsheets were created. One set was created out of the papermaking stock and contained no recycled or added papermaking sludge. One of the sets of handsheets was created from pulp that contained the papermaking stock and either 50 pounds or 100 pounds, respectively, of the papermaking sludge (untreated), based on the dried solids weight of the stock and the sludge. Another set of handsheets was created from papermaking pulp that contained the paper making stock and either 50 pounds or 100 pounds, respectively, of alum-treated sludge per ton of papermaking stock, based on the dried solids weight of the stock and the sludge. The alum-treated sludge contained 20 pounds of alum solution per ton of sludge, based on the dried solids weight of the sludge and alum solution. The fourth set of handsheets was created from papermaking pulp containing the papermaking stock and either 50 pounds or 100 pounds, respectively, of enzyme-treated sludge, based on the dried solids weight of the stock and the enzyme-treated sludge. The enzyme-treated sludge consisted of the papermaking sludge treated with one pound of enzyme solution per ton of sludge, based on the dried solids weight of the enzyme solution and the sludge. The enzyme solution was BUZYME™ 2524, available from Buckman Laboratories International, Inc., Memphis, Tenn., and contained about 10% by weight cellulase enzyme (Cellulase 50000). The enzyme-treated sludge also contained 20 pounds of alum solution per ton of paper making stock based on the dried solids weight of the alum solution and the paper making stock.

The effect that the addition of sludge had on the sheets was tested using the boat method, according to a method similar to that used in the mill. The handsheets were tested in a hot water bath having a temperature of about 40° C. Testing showed that the sheets having no sludge lasted twice as long (with an average life span of 1 hour and 15 minutes) as the sheets treated with raw sludge, which lasted only about 30 minutes.

The sheets that contained alum-treated sludge showed about a 10% increased life span relative to similar sheets containing the untreated sludge. However, the sheets containing the enzyme-treated sludge showed about a 30% increase in life span compared to the sheets containing the alum-treated sludge. Table 1 below shows the test results achieved from the 50 pound per ton additions of treated and untreated sludge. All weights are dried solids weight based on the dried solids weight of the stock.

TABLE 1

| Sample Number | Amount of Sludge (pounds per ton of stock) | Amount of Sizing (pounds per ton of stock) | (Time seconds) |
|---|---|---|---|
| 1 and 2 | 0 | 0 | 20 |
| 3 and 4 | 0 | 7 | 4,500 |
| 5 and 6 | 0 | 15 | 6,000 |
| 7 and 8 | 50 (untreated) | 7 | 1,800 |
| 9 and 10 | 50 (untreated) | 15 | 2,700 |
| 11 and 12 | 50 (alum-treated) | 7 | 2,100 |
| 13 and 14 | 50 (enzyme-treated) | 7 | 3,000 |

These samples were duplicated several times and the results were substantially identical in each case. The sheets treated with 100 pounds of the sludge, whether the sludge was treated or untreated, showed about a 20% decrease in life span in all categories comparable to those of samples 7–14 shown in Table 1 above.

These results indicate that adding sludge to the papermaking stock adversely affects the life span of paper sheets made from the resulting pulp. Treating the sludge with an enzyme solution prior to incorporating the treated sludge into the papermaking stock improved the life span of the resulting sheets in hot water bath life span testing.

Example 2

Figure 2:
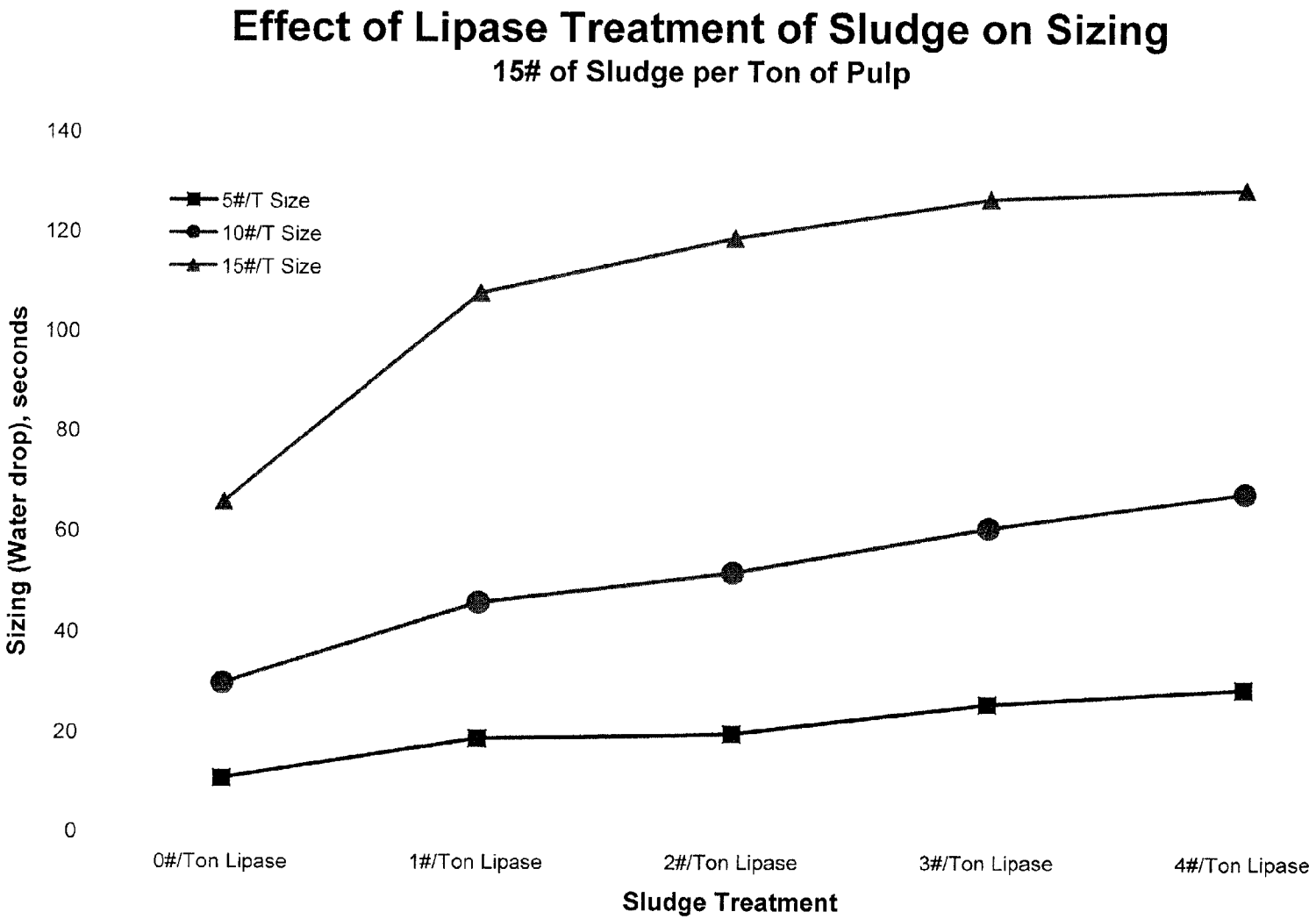
FIG. 2 is a graph showing the effect that an enzyme-treated sludge has on the sizing of a paper product made by a process according to an embodiment of the present invention.
Figure 3:
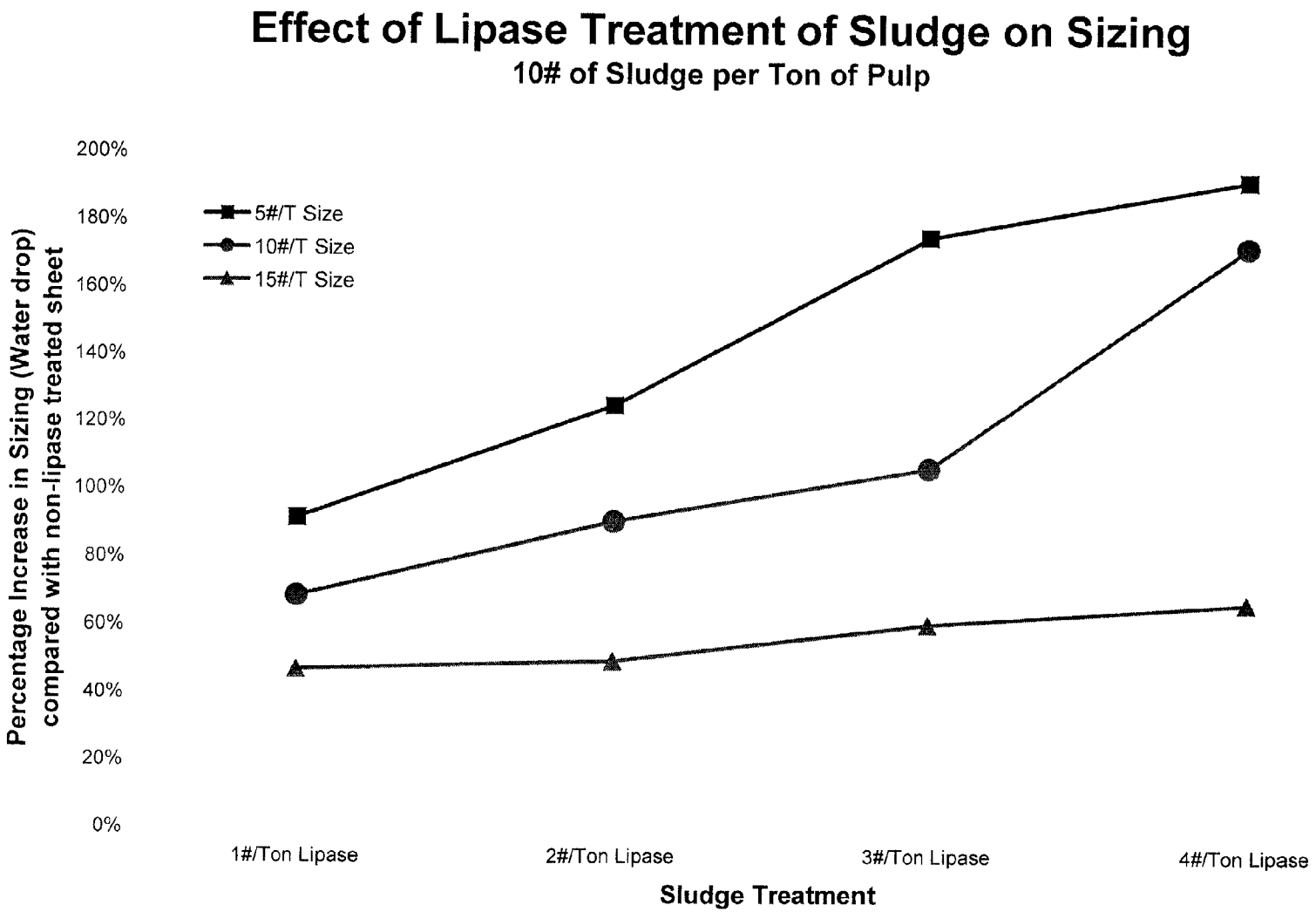
FIG. 3 is a graph showing the percentage increase in sizing in a paper product made by a process according to an embodiment of the present invention wherein lipase-treated papermaking sludge is incorporated into a papermaking pulp used to make the product.
Figure 4:
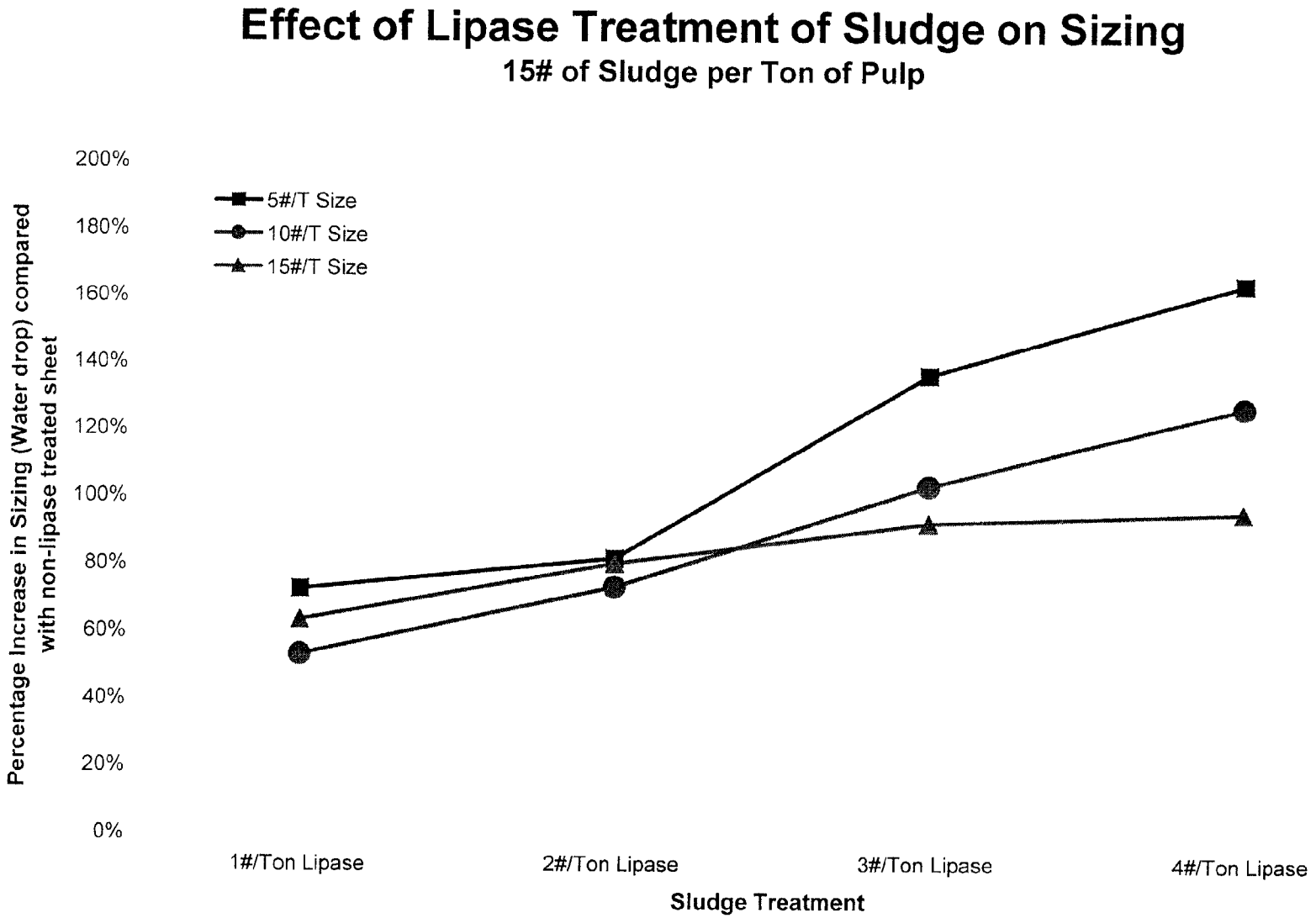
FIG. 4 is a graph showing the percentage increase in sizing in a paper product made by a process according to an embodiment of the present invention wherein lipase-treated papermaking sludge is incorporated into a papermaking pulp used to make the product.

In this example, a freshly-acquired composite sludge sample was treated with dosages of from one pound to four pounds, respectively, of lipase per ton of sludge, based on the dried solids weight of the lipase and the sludge. Treatment of the sludge lasted for 30 minutes, after which time the treated sludge was mixed with a papermaking pulp at a rate of 10 pounds of treated sludge per ton of recycled fiber based on the dried solids weight of the sludge and the fiber. Each combined pulp slurry was sized with between 5 and 15 pounds of ASA sizing per ton of papermaking stock. The ASA sizing material was emulsified with polymers. The resulting pulps were prepared into handsheets and water drop measurements were taken for each sheet. The water drop tests is a standard TAPPI method where a drop of water is dropped onto the sheet and the time for the water to adsorb into the sheet is measured. The time that it takes for the drop of water to adsorb into the sheet is recorded as the result. As shown in Tables 2 and 3 below, and graphically demonstrated in FIGS. 1–4, the sizing of each resultant handsheet increased with increasing lipase treatment for each increasing sizing material level.

TABLE 2

Addition of 10 pounds of sludge per ton of papermaking pulp
Sizing Results (Water Drop), in seconds

| Sample No. | Pounds of Lipase per ton of papermaking sludge | 5 pounds of sizing per ton of papermaking sludge | 10 pounds of sizing per ton of papermaking sludge | 15 pounds of sizing per ton of papermaking sludge |
|---|---|---|---|---|
| 15 | 0 | 12 | 32 | 83 |
| 16 | 1 | 23 | 54 | 122 |
| 17 | 2 | 27 | 61 | 124 |
| 18 | 3 | 33 | 66 | 133 |
| 19 | 4 | 35 | 87 | 138 |

TABLE 3

Addition of 20 pounds of sludge per ton of papermaking pulp
Sizing Results (Water Drop), in seconds

| Sample No. | Pounds of Lipase per ton of papermaking sludge | 5 pounds of sizing per ton of papermaking sludge | 10 pounds of sizing per ton of papermaking sludge | 15 pounds of sizing per ton of papermaking sludge |
|---|---|---|---|---|
| 20 | 0 | 11 | 30 | 66 |
| 21 | 1 | 19 | 46 | 108 |
| 22 | 2 | 20 | 52 | 119 |
| 23 | 3 | 26 | 61 | 127 |
| 24 | 4 | 29 | 68 | 129 |

It will be apparent to those skilled in the art that various modifications and variations can be made to the embodiments of the present invention without departing from the spirit or scope of the present invention. Thus, it is intended that the present invention covers other modifications and variations of this invention provided they come within the scope of the appended claims and their equivalents.

What is claimed is:

1. A method of improving sizing in a paper or paperboard product, comprising:

combining a papermaking sludge with an enzyme composition to form an enzyme-treated sludge;

combining said enzyme-treated sludge with a papermaking pulp to form a treated pulp; and forming a paper or paperboard product from said treated pulp, wherein said product has improved sizing compared to the sizing of an identical paper or paperboard product but not having the sludge treated with enzyme composition, wherein said enzyme composition comprises at least one polyamide oligomer and at least one cellulytic enzyme.

2. A method of improving sizing in a paper or paperboard product, comprising:

combining a papermaking sludge with an enzyme composition to form an enzyme-treated sludge, wherein said enzyme composition comprises at least one of a protease, an esterase or a lipase;

combining said enzyme-treated sludge with a papermaking pulp to form a treated pulp; and forming a paper or paperboard product from said treated pulp, wherein said product has improved sizing compared to the sizing of an identical paper or paperboard product but not having the sludge treated with enzyme composition.

3. The method of claim 2, wherein said enzyme-treated sludge is added in an amount of from about 1 pound per ton of papermaking pulp to about 50 pounds per ton of papermaking pulp based on the dried solids weight of both the enzyme-treated sludge and the papermaking pulp.

4. The method of claim 2, wherein said papermaking pulp comprises a sizing material.

5. The method of claim 2, wherein said papermaking pulp comprises an ASA sizing emulsion.

6. The method of claim 2, wherein said improved sizing comprises an improved retention of sizing material.

7. The method of claim 2, wherein said improved sizing comprises an improved resistance to size reversion.

8. The method of claim 2, wherein said enzyme composition has cellulytic activity.

9. The method of claim 2, wherein said enzyme composition has both cellulytic and hemicellulytic activity.

10. The method of claim 2, wherein said enzyme composition has lipase activity.

11. The method of claim 2, wherein said enzyme composition is added to said papermaking sludge in an amount of from about 1.00% by weight to about 0.001% by weight active enzyme based on the dried solids weight of both the active enzyme and the sludge.

12. The method of claim 11, wherein said enzyme composition comprises from about 5% by weight to about 20% by weight active enzyme based on the dried solids weight of both the active enzyme and the enzyme composition.

13. The method of claim 2, wherein said enzyme composition comprises said protease.

14. The method of claim 2, wherein said enzyme composition comprises said esterase.

15. The method of claim 2, wherein said enzyme composition comprises said lipase.

* * * * *